US010221595B2

(12) United States Patent
Ward et al.

(10) Patent No.: US 10,221,595 B2
(45) Date of Patent: Mar. 5, 2019

(54) LOCKING DEVICE

(71) Applicant: Einstein IP Limited, Tonbridge (GB)

(72) Inventors: Nicholas Ward, Hampshire (GB); Brian Clegg, St Aubin le Cloud (FR)

(73) Assignee: Einstein IP Limited, Tonbridge (GB)

( * ) Notice: Subject to any disclaimer, the term of this patent is extended or adjusted under 35 U.S.C. 154(b) by 0 days.

(21) Appl. No.: 15/039,517

(22) PCT Filed: Nov. 26, 2014

(86) PCT No.: PCT/GB2014/053505
§ 371 (c)(1),
(2) Date: May 26, 2016

(87) PCT Pub. No.: WO2015/079228
PCT Pub. Date: Jun. 4, 2015

(65) Prior Publication Data

US 2016/0376821 A1 Dec. 29, 2016

(30) Foreign Application Priority Data

Nov. 26, 2013 (GB) ..... 1320870.7

(51) Int. Cl.
*E06B 5/10* (2006.01)
*E05C 19/00* (2006.01)
(Continued)

(52) U.S. Cl.
CPC ..... *E05C 19/002* (2013.01); *E05B 63/0052* (2013.01); *E05B 63/242* (2013.01);
(Continued)

(58) Field of Classification Search
CPC ... E06B 7/22; E06B 7/16; E06B 7/215; E06B 7/18; E06B 2009/007; E06B 9/00;
(Continued)

(56) References Cited

U.S. PATENT DOCUMENTS 731,006 A * 6/1903 Wolfensperger ..... E06B 7/18 49/129
982,828 A * 1/1911 Kelly ..... E06B 7/18 49/319
(Continued)

FOREIGN PATENT DOCUMENTS

DE 44870 11/1887
DE 309730 3/1916
(Continued)

OTHER PUBLICATIONS

International Search Report dated Jun. 24, 2015, International Patent Application No. PCT/GB2014/053505.
(Continued)

*Primary Examiner* — Katherine W Mitchell
*Assistant Examiner* — Abe Massad
(74) *Attorney, Agent, or Firm* — Andrus Intellectual Property Law

(57) ABSTRACT

A locking device for a leaf pivotally mounted in a frame, the leaf having a leading face, a trailing face, a bottom edge and side edges, and being pivotally moveable relative to the frame between an open position and a closed position, the locking device comprising at least a first cam rotatable between an unlocked condition and a locked condition, the plane of rotation of the cam being perpendicular to the plane of the leaf when in the closed position, wherein in the locked condition the cam is engageable with a cam engaging surface on the leaf or the frame, engagement of the cam with the cam engaging surface preventing the leaf from moving away from the closed position.

14 Claims, 5 Drawing Sheets

(51) Int. Cl.

| | |
|---|---|
| ***E05B 63/00*** | (2006.01) |
| ***E05B 63/24*** | (2006.01) |
| ***E06B 7/16*** | (2006.01) |
| ***E06B 7/22*** | (2006.01) |
| ***E06B 9/00*** | (2006.01) |

(52) U.S. Cl.
CPC ..... *E06B 5/10* (2013.01); *E06B 7/16* (2013.01); *E06B 7/22* (2013.01); *E06B 9/00* (2013.01); *E06B 2009/007* (2013.01)

(58) Field of Classification Search
CPC ..... E06B 5/10; E05C 19/002; E05B 63/0052; E05B 63/242
See application file for complete search history.

(56) References Cited

U.S. PATENT DOCUMENTS

| | | | | | |
|---|---|---|---|---|---|
| 1,723,305 | A * | 8/1929 | Sipe | E05C 19/002 | 16/86 A |
| 2,359,244 | A * | 9/1944 | Polson | E05C 19/002 | 292/195 |
| 3,296,742 | A * | 1/1967 | Mortimer | B64C 1/1407 | 114/201 A |
| 4,064,651 | A * | 12/1977 | Homs | E05D 15/54 | 49/319 |
| 4,656,779 | A * | 4/1987 | Fedeli | E05C 19/001 | 49/318 |
| 6,185,871 | B1 * | 2/2001 | Wang | E05B 63/20 | 49/501 |
| 8,091,282 | B2 * | 1/2012 | Speyer | E05C 9/063 | 49/316 |
| 8,656,643 | B2 * | 2/2014 | Thielmann | E05C 9/063 | 49/303 |
| 2003/0213178 | A1 | 11/2003 | Fanucci | | |
| 2007/0290456 | A1 | 12/2007 | Speyer | | |
| 2008/0295410 | A1 * | 12/2008 | Salerno | E05C 19/002 | 49/394 |
| 2013/0000205 | A1 | 1/2013 | Raz | | |

FOREIGN PATENT DOCUMENTS

| | | | | |
|---|---|---|---|---|
| DE | 3447796 | | 7/1986 | |
| DE | 3447796 | A1 * | 7/1986 | E05B 15/1614 |
| DE | 202006017991 | | 3/2007 | |
| EP | 0094461 | A1 * | 11/1983 | E05C 19/002 |
| EP | 1120519 | | 8/2001 | |
| GB | 1166015 | | 10/1969 | |
| KR | 101351862 | | 1/2014 | |

OTHER PUBLICATIONS

GB Search Report, date of search May 1, 2015, GB Patent Application No. 1421011/6.

* cited by examiner

LOCKING DEVICE

CROSS REFERENCE TO RELATED APPLICATION

The present application is the U.S. national stage application of International Application PCT/GB2014/053505, filed Nov. 26, 2014, which international application was published on Jun. 4, 2015 as International Publication WO 2015/079228. The International Application claims priority of Great Britain Patent Application 1320870.7, filed Nov. 26, 2013.

FIELD OF THE INVENTION

The present invention relates to a locking device for a leaf pivotally mounted in a frame. The invention also relates to a leaf assembly comprising a leaf mounted in a frame and a locking device therefor.

BACKGROUND TO THE INVENTION

Locks for doors, windows and gates come in many forms from simple sliding bolts or rotating catches to modern multi-point locks including hooks, or cam rollers. Whilst the technology for locks has improved, the demands on doors have increased markedly. Doors are expected to not just close an aperture but are now expected to prevent determined intrusion and to seal against airflow in order to prevent heat loss.

In some specialist applications doors may be required to resist floodwater, blast, hurricanes or vehicles. In these cases the operation of the locking and sealing mechanisms may be very complex using worm gears, bevel gears, ratchets or other highly mechanised means. In some cases this operation may be aided by electronic means although this inevitably increases the cost and complexity of the locking apparatus significantly.

For buildings, such as dwellings, it is preferred to have inward opening doors for use as the main access door to the building. In the case of inward-opening doors, the locks are required to provide sealing compression in order to resist winds and in specialist applications to resist hydrostatic forces. This is despite the fact that the opening direction of the door is not at all advantageous as these forces will in effect be opening up the seal. This results in modern locks potentially working at the very edge of their performance capability and presents the risk of catastrophic failure.

With adjustable locks these may be tightened up to provide good compression against the forces trying to open the door or gate, however because of the load required to be applied through the handle or other means in which to operate the locks, the forces required to activate the locks may be beyond that provided in building or other regulation in some cases making it inoperable to many users. It will also potentially damage the soft seals through crushing, damage hinges or other elements through hyper-extending, and will still be vulnerable to catastrophic failure though failure of a fixing or snapping of a lock component. Handle forces required for operation and the sealing pressure required may be inextricably linked and induce an inherent weakness into the system.

SUMMARY OF INVENTION

According to a first aspect of the invention there is provided a locking device for a leaf pivotally mounted in a frame, the leaf having a leading face, a trailing face, a bottom edge and side edges, and being pivotally moveable relative to the frame between an open position and a closed position, the locking device comprising at least a first cam rotatable between an unlocked condition and a locked condition, the plane of rotation of the cam being perpendicular to the plane of the leaf when in the closed position, wherein in the locked condition the cam is engageable with a cam engaging surface on the leaf or the frame, engagement of the cam with the cam engaging surface preventing the leaf from moving away from the closed position.

The cam provides improved locking over prior art locks discussed above. The cam acts as a blocking device imparting a resistance to the opening of the leaf when the cam is in the locked condition through contact with the cam engaging surface on the leaf or the frame. This enhances locking compression and/or sealing of the leaf. Furthermore, as the plane of rotation of the cam is perpendicular to the plane of the leaf, the cam can be arranged such that exertion of a pushing force on the trailing face of the leaf to open it from a closed position will urge the cam in the direction of the locking condition, thus increasing sealing performance as the load on the leaf increases. As will be further explained below, a seal can be incorporated on the cam or on the cam engaging surface that the cam comes into contact with, therefore providing sealing or improved sealing for the door when the cam is in the locked condition. Where the cam is installed at the bottom edge of a leaf, the cam can be fully housed in a recess that is recessed such that its opening is flush with the floor, such that the device provides sealing at the bottom edge of the leaf, but without raising the threshold above the surrounding floor level.

In one embodiment the cam protrudes into the path of swing of the leaf or part of the leaf when the cam is in the in the locked condition. Suitably the trailing face of the leaf may be the outer face of the leaf, the leaf having an inner and an outer face. Suitably the locking device may be for a leaf for closing an aperture in a wall of a chamber, such as the external wall of a building, the leaf being pivotally mounted relative to the wall to swing inwardly in the direction of the inner surface of the leaf in order to open the leaf, and to swing in the opposite direction to close the leaf. The locking device is mountable so as to prevent the leaf from swinging inwardly from the closed position to an open position when the locking device is in the locked condition.

Since the plane of rotation of the cam is substantially perpendicular to the plane of the closed leaf, the axis of rotation of the cam is substantially parallel with the plane of the leaf.

The leaf can be any sort of door or window. For example, the leaf may be a patio door or a French window. Preferably the leaf is a flood resistant door.

As used herein, reference herein to a "frame" for the leaf includes any suitable fixed structure which supports the leaf and into which the leaf can close. The frame need not be a separate structure that mounts within an aperture around the leaf; the frame may be integral with the boundary wall/floor that surrounds the aperture. The cam engaging surface need not be any separate structure, and may of course be part of the surface of the frame or leaf.

As used herein, reference to a leaf's "leading face" refers to the face of a leaf that leads as the leaf swings from its closed to its open position. As used herein, reference to a leaf's "trailing face" refers to the face of a leaf that trails as the leaf swings from its closed to its open position.

Preferably the device is adapted such that when the or each cam is in the locked condition, the exertion of a leaf opening force on the trailing face of the leaf forms a seal, or enhances a seal between the leaf and the frame. Suitably this prevents the ingress of fluid, air-borne particles, heat or pressure between the leaf and the frame. Said leaf opening force may be a pushing force on the trailing face of the door. The seal may be formed between the cam and the leaf or the action of the cam due to the leaf opening force improving a seal between the leaf and the frame. The device may include suitable sealing means. For example, a seal can be incorporated on the cam or on the cam engaging surface that the cam comes into contact with. The locking device can act as the main seal for a leaf assembly, through tight manufacturing tolerances or by inclusion of a soft seal integral with the cam or cam engaging surface.

Preferably the device is adapted such that when the or each cam is in the locked condition, the exertion of a leaf opening force on the trailing face of the leaf urges the cam to rotate in the direction of the locked condition. The cam is mountable relative to the leaf such that a leaf opening force, such as a pushing force exerted on the trailing face of the door, will increase the effectiveness of the locking, rather than decrease as is the case for typical prior art locks.

Preferably the or each cam is mountable at a corresponding edge of the leaf, the cam being rotatable about an axis of rotation which is parallel with said edge of the leaf. The cam may be mountable on the leaf or the frame, at said edge of the leaf. Suitably the leaf may have a bottom edge and two vertical side edges Preferably the or each cam is biased in the unlocked condition. Preferably the device further comprises biasing means for biasing the or each cam in the unlocked condition. Preferably the biasing means is a spring. Preferably the biasing means is a compression spring. The compression spring may act as a return spring, returning the cam to the unlocked condition. Alternatively any other sort of suitable biasing means may be used, such as a leaf spring or constant torque spring.

Preferably the or each cam comprises a cam surface and a lever portion, the cam surface being engageable with the cam engaging surface when the cam is in the locked condition.

Preferably the or each cam is rotatable about an axis of rotation located between the cam surface and the lever portion, such that the cam surface rotates in an opposite direction from the lever portion as the cam moves between the locked and unlocked conditions.

Preferably the device further comprises actuating means for rotating the or each cam from the unlocked to the locked condition. The cam may therefore be operated without the need for the user to manually move the lever portion directly. The actuating means can be operated remotely, without requiring direct access to the actuating means, such that a user on either side of the leaf can cause the cam to move between the locked and unlocked conditions. The locking device may comprise control means for controlling the actuating means. The control means may be remote from the actuating means. For example, the control means may be displaced from the actuating means such that the control means are easily accessible by the user. The control means may comprise a control means on both the leading face of the leaf and a control means on the trailing face of the leaf so that a user on either side of the leaf can cause the cam to move between the locked and unlocked conditions.

Preferably the actuating means exerts a force in use on the lever portion in order to move the cam from unlocked to the locked condition. Preferably the actuating means exerts a pushing force in use on the lever portion in order to move the cam from unlocked to the locked condition. Preferably the actuating means comprises a linear actuator. Suitably the linear actuator is moveable linearly between a retracted position and an extended position. Preferably the linear actuator is moveable linearly between a retracted position and an extended position in which it exerts a pushing force on the lever portion of the cam. Preferably the actuating means comprises a pneumatic, hydraulic, mechanical, electro-magnetic, or electro-mechanical actuator. Where the actuator is mechanical, it may incorporate a worm-gear, bevel gears, electro-magnetic or a rack and pinion mechanism. Preferably the actuator is a hydraulic piston.

Preferably the locking device further comprises a first cam sealing member which is located such that the sealing member is disposed between the cam and the cam engaging surface when the cam is in the locked condition. The cam sealing member may be adapted to form a water-tight seal when the cam is in the locked condition.

Preferably said cam sealing member is disposed on the cam. Suitably the cam sealing member may be disposed on the cam surface. The sealing member may be any suitable material, such as a resilient material. The sealing member may be made of a waterproof material. Alternatively the sealing member may be disposed on the cam engaging surface, or on both the cam surface and the cam engaging surface.

Preferably the or each cam is elongate. The elongate cam has a longitudinal axis, the cam being mountable with its longitudinal axis parallel with the edge of the leaf that the cam is mountable at. An elongate cam provides continuous sealing along the length of the cam when the cam is in the locked condition. Use of an elongate cam furthermore provides improved locking over prior art locks, such as bolts, that are subject to intense point loading, making the lock only as strong as the leaf or the frame it engages with.

Preferably the or each elongate cam has a longitudinal axis and the length of the cam along the longitudinal axis substantially matches the length of the edge of the leaf that the cam is mountable at. For example, the elongate cam can span along approximately the full length of the bottom edge of the leaf.

Preferably the or each cam comprises a cam surface and a lever portion, the cam surface being engageable with the cam engaging surface when the cam is in the locked condition, said cam surface having an arcuate profile. Alternatively said cam surface may have a non-arcuate profile. For example, at least part of said cam surface may be substantially planar. Said cam surface may be configured to engage a substantially planar cam engaging surface disposed substantially obliquely to the plane of the leaf in its closed position. Said cam may comprise a head portion and a lever portion, the head portion being furcated, having a first furcation including a cam surface thereon which is engageable with the cam engaging surface when the cam is in the locked condition, and a second furcation configured to engage a sealing projection when the cam is in the locked condition.

According to a further aspect of the invention there is provided a leaf assembly comprising a leaf and a frame, the leaf being pivotally mounted in the frame, the leaf having a leading face, a trailing face, a bottom edge and side edges, and being pivotally moveable relative to the frame between an open position and a closed position, the assembly further comprising a locking device having any of the features described above. The leaf assembly with locking device is therefore a lockable leaf assembly.

Preferably the frame comprises a flange arranged to overlie at least part of the periphery of the leaf when the leaf is in the closed position. Suitably the flange will overlie at least a part of the periphery of the trailing face of the leaf when the leaf is in the closed position. Preferably the frame further comprises a first flange sealing member located such that it is disposed between the flange and the leaf when the leaf is in the closed position. Preferably the flange sealing member is disposed on the flange. Alternatively the flange sealing member may be disposed on the periphery of the trailing face of the leaf. The flange sealing member may be adapted to form a water-tight seal when the leaf is under compression Preferably the or each cam is mountable within a corresponding carrier recess, the carrier recess being in the leaf or the frame. The carrier recess may be an elongate channel in the leaf or frame. Each cam may have a corresponding carrier recess. Preferably at least part of the cam is housed within the carrier recess when the cam is in the unlocked condition. Preferably the assembly is adapted such that when the cam is in the unlocked condition, the cam is fully housed within the carrier recess. Where the cam is mounted at the bottom edge of a leaf, this can allow a level threshold to be provided when the cam is in the unlocked condition.

Preferably the assembly is adapted such that when the cam is in the unlocked condition, a surface of the cam is flush with the surface of the frame or leaf in which the carrier recess is disposed. The cam may have a planar surface that sits flush with the surface of the frame or leaf in which the carrier recess is disposed when the cam is in the unlocked condition. This means that for a cam mounted at the bottom edge of the leaf with the carrier recess recessed in the frame, a level threshold is provided when the cam is in the unlocked condition. As described above, the cam can have a substantially planar surface adapted to face away from the carrier recess when mounted. In such a situation, the frame can be installed such that the upper face of the bottom edge of the frame is flush with the surrounding floor, so as to provide a level threshold when the cam is in the unlocked condition.

Preferably the cam engaging surface is disposed on the leaf or the frame. Preferably the cam engaging surface is disposed in a corresponding receiving recess, the receiving recess being in the leaf or the frame. The receiving recess may be an elongate channel. Each cam may have a corresponding receiving recess. Alternatively the cam engaging surface may be on an inner surface of the leaf rather than in a recess. Where the carrier recess is in the frame, the receiving recess will be in the leaf and vice versa. Where the carrier recess or receiving recess is in the leaf, it is in the edge of the leaf, the cam being mounted, when assembled, adjacent said edge of the leaf.

Preferably the carrier recess is adjacent the receiving recess when the leaf is in the closed position. Therefore, the carrier recess and receiving recess will communicate when the leaf is in the closed position. In one embodiment, the carrier recess is in the frame and the receiving recess is in the leaf Preferably the locking device of the leaf assembly further comprises a second cam, the first cam being mountable at a first corresponding edge of the leaf and the second cam being mountable at a second corresponding edge of the leaf, the second cam being rotatable between an unlocked condition and a locked condition, the plane of rotation of the second cam being perpendicular to the plane of the leaf when in the closed position, wherein in the locked condition the second cam is engageable with a corresponding cam engaging surface, engagement of the cam with the cam engaging surface preventing the leaf from moving away from the closed position. For example, the assembly can include one cam mounted at the bottom edge of the leaf and one cam mounted at a side edge. Alternatively it could include first and second cams mounted at first and second side edges of the leaf.

Preferably the locking device of the leaf assembly further comprises a third cam, the third cam being mountable at a third corresponding edge of the leaf, the third cam being rotatable between an unlocked condition and a locked condition, the plane of rotation of the third cam being perpendicular to the plane of the leaf when in the closed position, wherein in the locked condition the third cam is engageable with a corresponding cam engaging surface, engagement of the cam with the cam engaging surface preventing the leaf from moving away from the closed position. For example, the assembly can have one cam mounted at the bottom edge of the leaf and a cam mounted at each side edge. The cam mounted at the bottom edge can have a length that substantially matches the length of the edge of the bottom edge of the leaf. The cams at the side edges may extend partway up the side edges of the leaf from the bottom edge.

Preferably the locking device of the leaf assembly further comprises a fourth cam, the fourth cam being mountable at a fourth corresponding edge of the leaf, the fourth cam being rotatable between an unlocked condition and a locked condition, the plane of rotation of the fourth cam being perpendicular to the plane of the leaf when in the closed position, wherein in the locked condition the fourth cam is engageable with a corresponding cam engaging surface, engagement of the cam with the cam engaging surface preventing the leaf from moving away from the closed position. For example, the assembly can have one cam mounted at the bottom edge of the leaf and a cam mounted at each side edge and a cam mounted at the top edge.

Preferably said first cam is adapted to form a mitred joint with an adjacent second cam when said first and second cams are in the locked condition. Similarly, the third cam will form a mitred joint with the adjacent cam. Similarly, the fourth cam will form a mitred joint with the adjacent cam. In order to form a mitred joint, the corresponding cam ends are angled with respect to the longitudinal axis of the corresponding cam. The mitred joint between adjacent cams provides a watertight seal along the cam lengths.

According to a further aspect of the invention there is provided a kit for assembly into a locking device or leaf assembly as described above, wherein the kit comprises the parts of the apparatus.

BRIEF DESCRIPTION OF THE DRAWINGS

A preferred embodiment of the present invention will now be more particularly described by way of example only with reference to the accompanying drawings, wherein.

DESCRIPTION OF THE PREFERRED EMBODIMENTS

The present embodiments represent currently the best ways known to the applicant of putting the invention into practice. But they are not the only ways in which this can be achieved. They are illustrated, and they will now be described, by way of example only.

Figure 1:
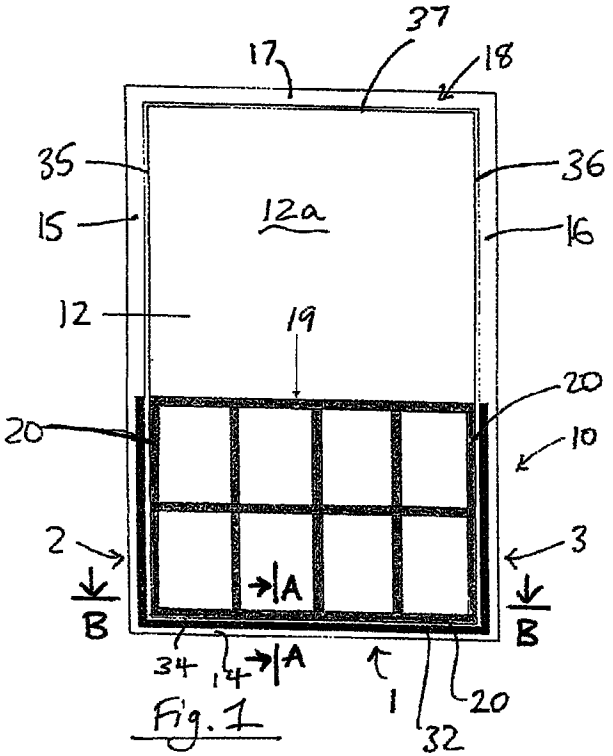
FIG. 1 is a front view of a door in a closed position in its frame.

Referring to FIG. 1, this diagrammatically shows a locking device 10 installed in a leaf assembly comprising a leaf 12 mounted in a corresponding frame 18, also known as a jamb. In this embodiment the leaf 12 is a moveable leaf and the frame 18 is fixed. The leaf can be any leaf, such as a door or gate, suitable for closing an aperture within the frame.

The locking device comprises a cam 20, which acts as a blocking member to resist movement of the leaf 12. The cam 20 is moveable between an unlocked condition in which it does not hinder the movement of the leaf 12 and a locked condition in which it resists the movement of the leaf 12, as will be further described below. The locking device includes an actuator means 40 for moving the cam 20 to the locked condition. The locking device also includes biasing means 44 for biasing the cam towards its unlocked condition.

The leaf 12 is a panel having an trailing face 12*a*, a leading face 12*b*, a bottom edge 34, first and second vertical side edges 35, 36, and a top edge 37. Frame 18 has a bottom frame member 14, a first vertical side frame member 15, a second vertical frame member 16, and top frame member 17. The frame 18 shown in the present embodiment sits within an aperture and supports the leaf 12, however the frame need not be a separate structure that mounts within the aperture. Instead, the frame may be integral with the boundary that surrounds the aperture, or may have some frame members that are integral with the boundary that surrounds the aperture. For example, the frame may comprise a section of the floor, modified appropriately, at the bottom of the aperture, serving as the bottom frame member, and separate side and top frame members that fit within the aperture.

The leaf 12 is hingedly mounted in the frame at either the first or second vertical side edge 35, 36. The leaf 12 is moveable relative to the frame 18 between a closed position (as shown in the figures) and an open position. The leaf closes an aperture in a wall (not shown) of a chamber, such as the external wall of a building, the leaf being pivotally mounted relative to the wall to swing inwardly into the chamber. In this embodiment, the trailing face 12*a* of the leaf faces the outside (i.e. the trailing face is an outer face) and the leading face 12*b* (not visible in FIG. 1) faces the inside of the chamber (i.e. the leading face is an inner face). In this embodiment, the leaf has a door skin 13 as its trailing face 12*a*. In this embodiment, the leaf is shown with a leaf reinforcing frame 19 within the structure of the leaf 12 (and shown diagrammatically in FIG. 1). The leaf reinforcing frame 19 may be made from aluminium box sections. Of course, the leaf 12 need not have either a skin 13 or reinforcing frame 19.

The locking device 10 is mounted between the leaf 12 and the frame 18, along the bottom edge 34 of leaf 12 and partway along each vertical side edge 35, 36. The locking device will be further explained below with reference to FIGS. 2 to 5.

The locking device comprises a first cam assembly 1, having a cam 20 mounted at the bottom edge 34 of leaf 12 and rotatable relative to the frame 18 and leaf 12. The locking device of this embodiment further comprises a second cam assembly 2 with cam 20 mounted at the first side edge 35 of leaf 12 and a third cam assembly 3, with cam 20 mounted at the second side edge 36 of leaf 12. Each of the first, second and third cam assemblies operate in the same way, and common reference numerals are used in the drawings of the first, second and third cam assemblies to refer to common features. The first cam assembly will be described further below, but the principles apply to the second and third cam assemblies as well.

Figure 2:
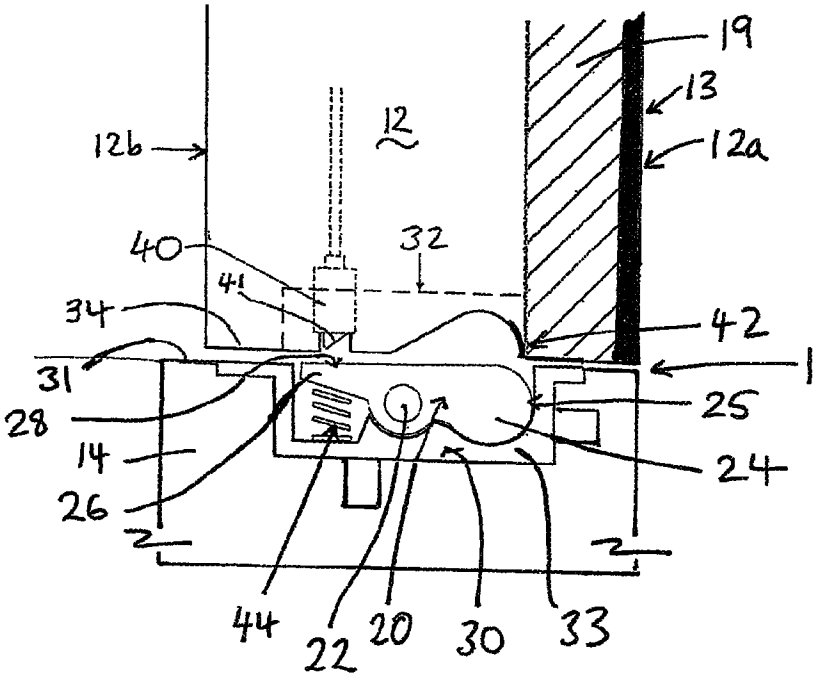
FIG. 2 is a cross-sectional view of the door of FIG. 1 along a plane indicated by A-A in FIG. 1, showing the bottom edge of the frame.

FIG. 2 shows a cross-sectional view through the bottom edge 34 of leaf 12 and bottom frame member 14. The cam assembly 1 comprises a first cam 20 rotatably mounted relative to the frame 18 and leaf 12. The face 31 of frame member 14 that faces leaf 12 has a carrier recess 30 recessed into it, in which the cam 20 is housed. The carrier recess 30 is an elongate channel spanning the length of the bottom fame member 14. Each end of the carrier recess 30 channel may have a suitable end piece (not shown). The carrier recess 30 has a liner 33 received within the recess 30 and shaped to receive the cam 20. The liner 33 is shaped to fit the cam 20 when it is in the unlocked condition, thus pushing out any water that may get into the liner 33.

Adjacent and communicating with the carrier recess 30 is a receiver recess 32, recessed in the bottom edge 34 of the leaf 12. The receiver recess 32 is an elongate channel spanning the length of the bottom edge 34 of leaf 12.

The cam 20 is elongate and spans the length of the bottom edge 34 of leaf 12. The cam 20 is rotatable about the cam's rotational axis, which comprises an elongate pivot pin 22. The pivot pin 22 has two ends, each end preferably being mounted to the frame 18 (mountings not shown in the figures).

The cam has a head portion 24 and a lever portion 26, arranged one on each side of the pivot pin 22. The head portion 24 has a rounded profile in the plane perpendicular with the cam's rotational axis/pivot pin 22, the rounded profile forming a cam surface 25.

Figure 3:
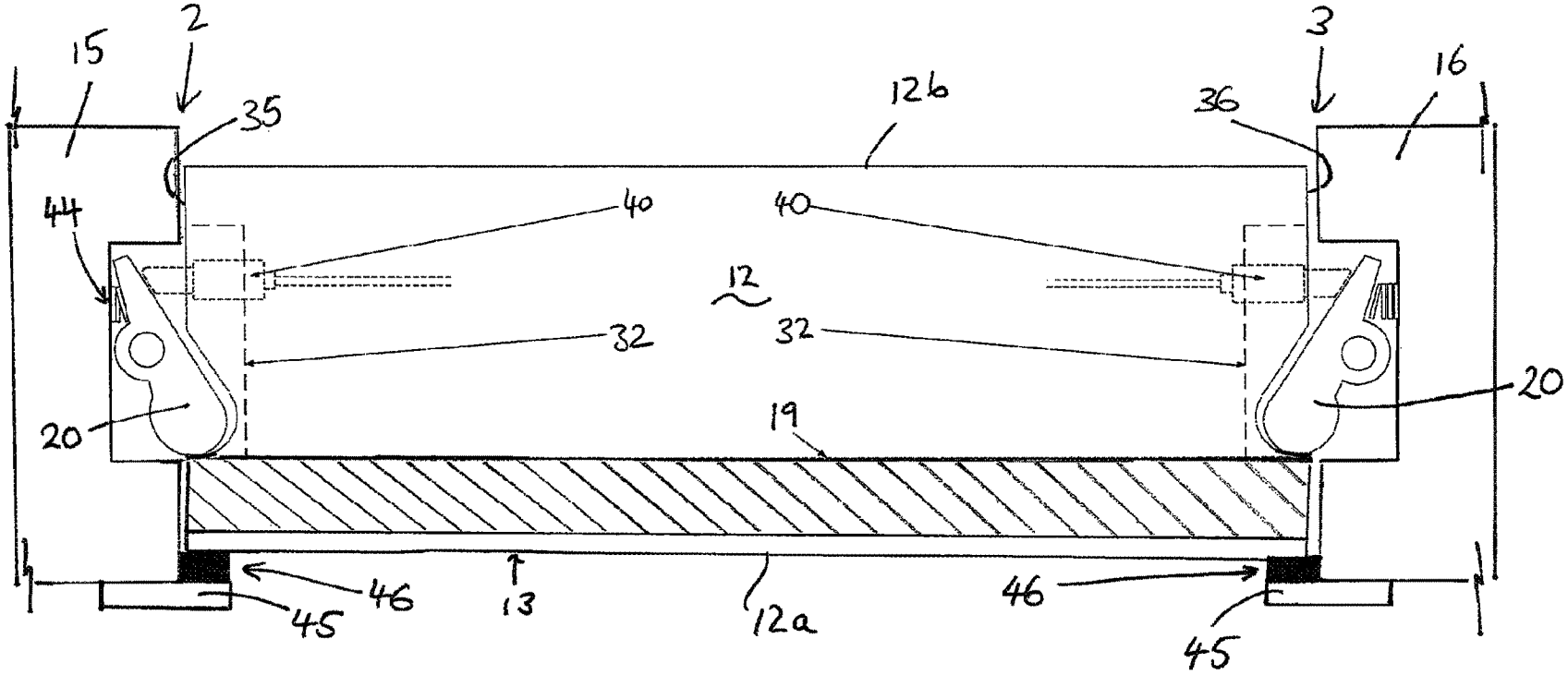
FIG. 3 is a cross-sectional view of the door of FIG. 1 along a plane indicated by B-B in FIG. 1, showing the two vertical side edges of the frame.

The first cam assembly 1 further comprises actuating means, being a linear actuator 40. The linear actuator 40 is a hydraulic piston, shown in FIG. 2 as housed within the leaf 12. Alternatively, if the leaf 12 were not as thick as the embodiment shown in the figures, then the actuating means could be mounted to the leading face 12*b* of the leaf 12. The linear actuator 40 has a piston that is moveable hydraulically between a retracted position, as shown in FIG. 2, and an extended position, in which it engages and pushes lever portion 26 of the cam towards the frame 18 (as shown in FIG. 3, but shown therein for the second and third cam assemblies). Movement of the linear actuator 40 from the retracted to the extended position allows the cam 20 to be rotated to the locked condition as will be further described below. Control means (not shown) may be included for controlling the linear actuator 40.

The cam 20 is rotatable between a first, unlocked condition and a second, locked condition. The cam 20 is shown in the unlocked condition in FIG. 2, in which the cam 20 is fully housed within the carrier recess 30. The cam 20 has a planar surface 28 facing towards the leaf 12, the planar surface 28 being flush with the face 31 of frame member 14 that faces leaf 12 when the cam 20 is in the unlocked condition.

The distal end 41 of the linear actuator 40 piston is angled such that it faces towards the leaf 12. The distal end 41 of the linear actuator 40 piston lies against the planar surface 28 of lever portion 26 when the cam 20 is in the locked condition (as shown in FIG. 3 for the second and third cam assemblies 2,3).

The cam 20 is rotatable from the unlocked condition to the locked condition by means of rotating the head portion 24 towards the leaf 12 and the lever portion 26 away from the leaf. Rotation of the cam 20 from the unlocked condition to the locked condition is actuated by means of movement of the linear actuator 40 from its retracted position to its extended position. In the extended position, the linear actuator 40 engages and pushes lever portion 26 of the cam towards the bottom frame member 14, causing the cam 20 to rotate to the locked condition.

The locked condition of the cams 20 of the second and third cam assemblies 2,3 is shown in FIG. 3, but it will be understood that this is equivalent to the locked condition for the cam 20 of the first assembly 1 as well. In the locked condition, the cam surface 25 of heard portion 24 can engage a cam engaging surface 42 in the receiver recess 32. The cam may exert a pushing force on the cam engaging surface when in the locked condition, such force depending on the tolerances selected for the components. In this embodiment, the cam engaging surface 42 of the receiver channel 32 is a cam sealing member which is located in the receiver channel 32 so as to be engageable with the cam surface 25 when the cam is in the locked condition. The sealing member can be any resilient material, preferably waterproof, for forming a seal between the cam 20 and the leaf 12, such as EDPM rubber. As the cam 20 moves into the locked condition, the cam surface 25 slides against the cam sealing member 42, forming a seal between the cam 20 and the leaf 12. Ingress of water between the leaf 12 and edge of the frame 18 at which the cam is mounted will be prevented by the seal formed between cam 20 and the leaf 12 at said edge. Alternatively the cam sealing member may be disposed on the cam 20 such that it forms the cam surface 25 of the head portion 24, which will engage with a corresponding cam engaging surface in the receiver channel 32, with or without a sealing member thereon.

There is a return spring 44, being a compression spring, assembled between the lever portion 26 of the cam and the carrier recess 30. The return spring 44 biases the cam 20 into the unlocked condition. When the linear actuator 40 is returned to its retracted position, such that the piston is no longer pushing lever portion 26 away from the leaf 12, the cam 20 returns to the unlocked condition.

In operation in order to use the cam 20 to lock the leaf in the closed position, the linear actuator 40 is moved from the retracted to the extended position. The piston of the linear actuator 40 pushes on the lever portion 26 of the cam, causing the cam 20 to rotate from the unlocked condition to the locked condition, wherein the cam surface 25 can engage a cam engaging surface 42 on the leaf 12. If any pushing force is applied to the trailing face 12*a* of the leaf 12, such pushing force is resisted by the cam engaging with the cam engaging surface 42. Furthermore, any pushing force applied to the trailing face 12*a* of the leaf 12 (for example in the direction of arrows A shown in FIGS. 4 and 5) will urge the cam 20 further in the rotational direction of its locked condition, thus enhancing the sealing performance of the assembly. For example, in flooding conditions, hydrostatic load on the outer door skin exerts force on the horizontally and vertically arranged cams 20, increasing the sealing performance.

As described above, the planar surface 28 of the cam 20 is flush with the face 31 of frame member 14 that faces the trailing face 12*a* of the leaf 12 when the cam 20 is in the unlocked condition. In this way, the planar surface 28 forms a level threshold when the cam 20 is in the unlocked condition. The planar surface 28 is flush with the level of the floor that the leaf swings over when opening and closing, thus providing a level threshold for the leaf. A level threshold is desirable for doors that require easy wheelchair access and to avoid tripping hazards of a non-level threshold. The cam assembly 1 provides a means for sealing the bottom edge 34 of the leaf, without there being any portion of the threshold that is raised above the surrounding floor when the leaf is in the open position. The cam preferably forms a gas-tight fit in the corresponding liner when in the unlocked condition, thus providing a good seal preventing water from entering the carrier recess for example.

The second and third cam assemblies 2,3 are shown in FIG. 3, and it will be understood that these are very similar to the first cam assembly 1. In this embodiment, each cam assembly 1,2,3 has its own corresponding linear actuator 40 to activate the corresponding cam 20. Referring to FIG. 1, unlike the cam 20 of the first assembly 1, the cams of the second and third cam assemblies 2,3 extend partway up the first and second sides 35,36 of the leaf 12 respectively. In this way, the second and third cam assemblies 2,3 can act to seal the aperture against the ingress of flood water up to the height extended by the cams 20 of the second and third cam assemblies 2,3. Alternatively, the cams of the second and third cam assemblies 2,3 can span the full length of the first and second sides 35,36 of the leaf 12 respectively.

The ends of the cam 20 of first cam assembly 1 and the lower ends of each cam of the first and second cam assemblies 2,3 are shaped such that they form mitred joints where the cam 20 of the first cam assembly 1 meets each cam of the first and second cam assemblies 2,3 at the bottom side corners of the leaf 12, when the cams are in the locked condition. For example, each end of each cam that meets an adjacent cam at a corner may be cut as a segment to form a half lap-joint when the adjacent cams are in the locked condition. This allows a seamless cam 20 to be formed around the corners when the locking device 10 is in the locked condition.

Referring to FIG. 3, the frame 18 comprises a flange 45 which extends from the first and second frame members 15, 16 (and optionally also from the top frame member 17), to overlie the leaf 12 when the leaf is in the closed position. The flange is provided to provide a lip seal. Disposed on the inner surface of the flange 45 is a flange sealing member 46. When the leaf 12 is in the closed position, the leaf 12 presses against the flange sealing member 46, providing a seal between the leaf 12 and the frame 18. Any compressive force exerted on the leaf 12 by engagement of the cams 20 with their corresponding cam engaging surfaces 42 will enhance the sealing provided by the flange sealing member 46.

The second and third cam assemblies 2,3 do not include a liner 33 in their respective receiver channels 30, however a liner 33 could of course be included.

Figure 4:
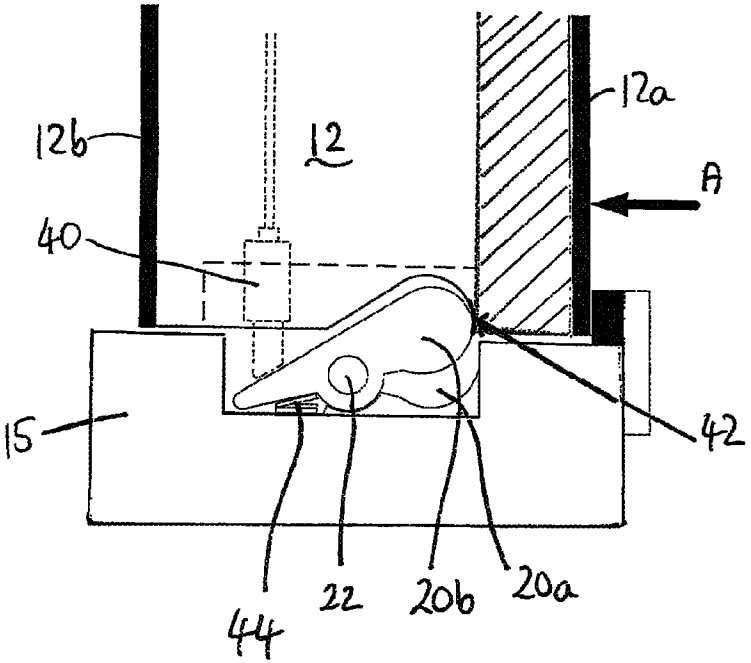
FIG. 4 is a view similar to that of FIG. 3, but showing the cam in both the locked and unlocked conditions.

FIG. 4 shows the second cam assembly 2 with outlines of the cam 20 to show it in both the unlocked 20*a* and locked 20*b* conditions. The second and third cam assemblies 2,3 operate as described in relation to the first cam assembly 1.

The locking device may include only a first cam assembly mounted at the bottom edge 34 of the leaf 12. This provides a seal against ingress of water under the door by means of sealing engagement between the cam 20 and the cam engaging surface 42. The engagement of the cam 20 with the cam engaging surface 42 also enhances the seal provided by the flange sealing member 46 disposed along the side frame members 15, 16, thus enhancing compression of the closed leaf and therefore enhancing sealing along the sides of the leaf.

Figure 5:
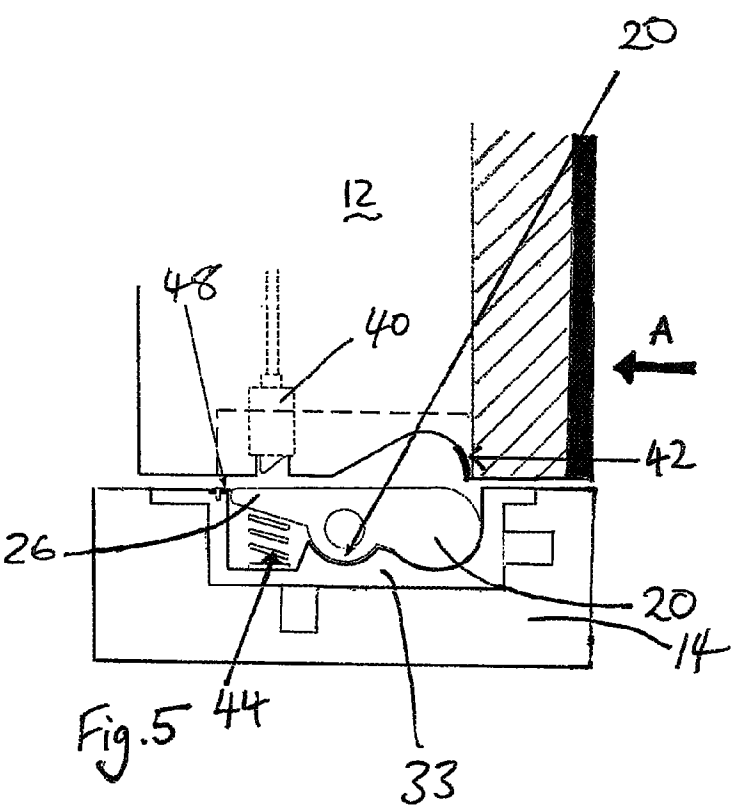
FIG. 5 is a similar cross-sectional view to that of FIG. 2, but the assembly additionally has a sealing strip to keep debris from filling into the carrier recess.

Referring to FIG. 5, the first cam assembly 1 is shown, however in this figure the assembly has an additional sealing strip 48 disposed over the gap between the lever portion 26 of the cam and the receiver recess 30. The sealing strip 48 keeps debris from falling into the receiver recess 30. There may also be a similar sealing strip at the other end of the receiver recess. The second and third cam assemblies 2,3, which extend along the side edges 35, 36 of the leaf may have similar sealing strips, although the chance of debris falling into the corresponding receiver channels is lower for a vertical assembly than a horizontal assembly placed at floor level.

The locking device may further comprise a fourth cam assembly (not shown in the figures) with a cam mounted at the top edge 37 of leafe 12. A fourth cam assembly will operate in the same way as the first, second and third cam assemblies.

The cam 20 of each cam assembly 1,2,3 may be short, spanning just a portion of the edge of the corresponding leaf 12. Where the cam is elongate, each cam may be a single continuous elongate member. Alternatively, the elongate cam 20 of each cam assembly 1,2,3 may be comprised of a number of cam sections that are individually actuated by separate linear actuators 40, or actuated by a single linear actuator 40, with the cam sections being coupled, such that actuation of one cam section actuates the others.

In each cam assembly 20, instead of mounting the cam 20 in a carrier channel in the corresponding frame member 14, 15 or 16, the cam 20 can be mounted to a carrier channel in the corresponding edge of the leaf 12. If so, the cam 20 will engage with the corresponding frame member 14, 15 or 16, or extend into and engage with a receiver channel in the corresponding frame member 14, 15 or 16, when in the locked condition.

Figure 6:
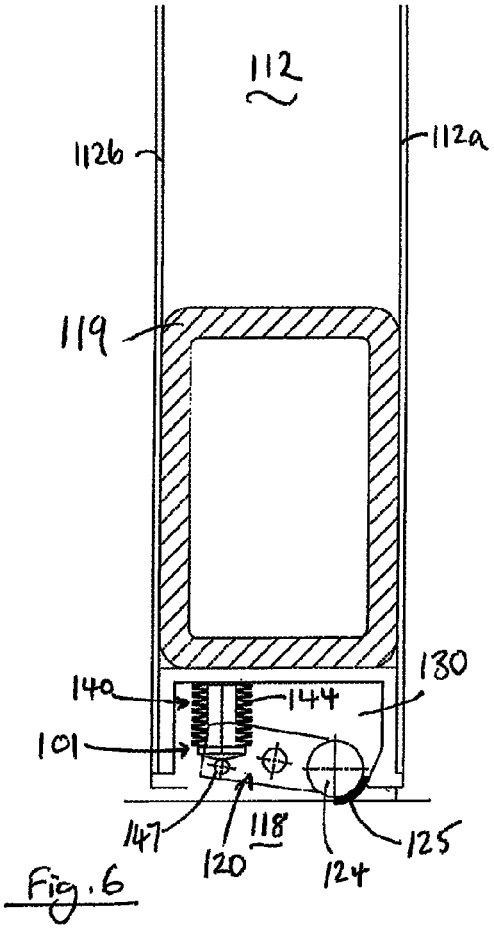
FIGS. 6 and 7 show cross-sectional views of an alternative embodiment with the locking device in locked and unlocked conditions respectively.
Figure 7:
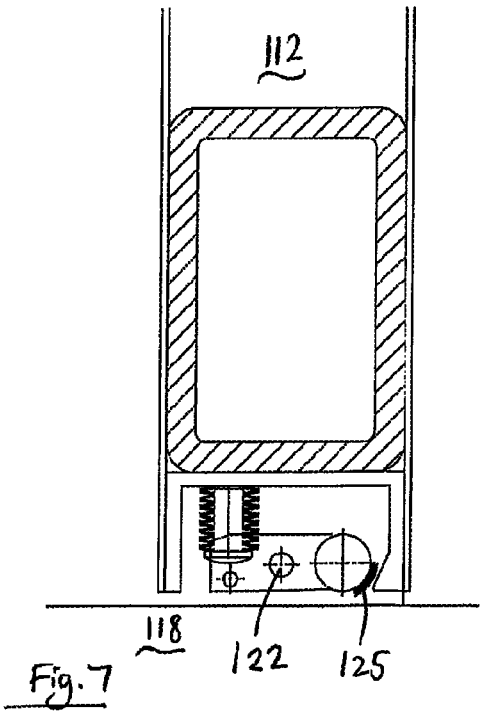

FIGS. 6 and 7 show an alternative embodiment of the locking device in which the cam 120 is housed in a carrier recess 130 in the edge of the leaf 112, rather than in the leaf frame. Similar reference numerals are used to refer to similar parts in the various embodiments. In the present embodiment the cam 120 is configured to engage a cam engaging surface on the frame 118 when in the locked condition. One cam assembly for one edge of a leaf is shown in FIGS. 6 and 7, however the skilled reader will readily understand that further cam assemblies may be provided for use with a single leaf. The cam assembly 101 comprises a cam 120 rotatably mounted to leaf 112. The edge of leaf 112 has a carrier recess 130 therein, in which the cam 120 is housed. Like the previous embodiment, the carrier recess 130 is an elongate channel. In the present embodiment, the frame 118 does not have a receiver recess and therefore the frame members each present level, unrecessed surfaces facing towards the leaf 112. However it will be understood that the assembly may be adapted such that the frame 118 includes a carrier recess for receiving each cam 120. In this embodiment, the cam engaging surface on frame 118 is simply the part of frame 118 that cam surface 125 engages when in the locked condition.

The cam 120 has a head portion 124 and a lever portion 126 arranged about a pivot axis 122. The head portion 124 has a rounded profile forming cam surface 125. The lever portion 126 is pivotally coupled to actuator means 140 at a pivot axis 147 distanced from the head portion 124, such that cam is rotatable about rotation axis 122, rotation axis 122 being located between axis 147 and head portion 124. The actuator means 140 is configured to move between an extended position, shown in FIG. 7, wherein the cam 120 is in an unlocked condition, and a retracted position, shown in FIG. 6, wherein the cam 120 is in a locked condition. The actuator means 140 is any suitable linear actuator means, such as a hydraulic actuator or other suitable mechanism that is capable of extension/retraction. The actuator means 140 includes a return spring 144 being a compression spring to bias the cam 120 into the unlocked condition. The cam has a planar surface 128 facing towards frame 118, the planar surface 128 being flush with the face of the leaf that faces the frame 118 when the cam 120 is in the unlocked condition. In this embodiment the cam surface 125 has a cam sealing member disposed thereon, which engages a cam engaging surface (namely the inward facing face of frame 118) when the cam is in the locked condition. As in the previous embodiment, the cam sealing member may be any resilient material for forming a seal between the cam 120 and the frame 118 when the cam 120 engages frame 118. In operation to move the cam into the locked condition, the linear actuator 140 is moved from the extended to retracted position to move the head portion 124 of the cam into engagement with the frame 118. This operation is reversed the move the cam into the unlocked condition.

Figure 8:
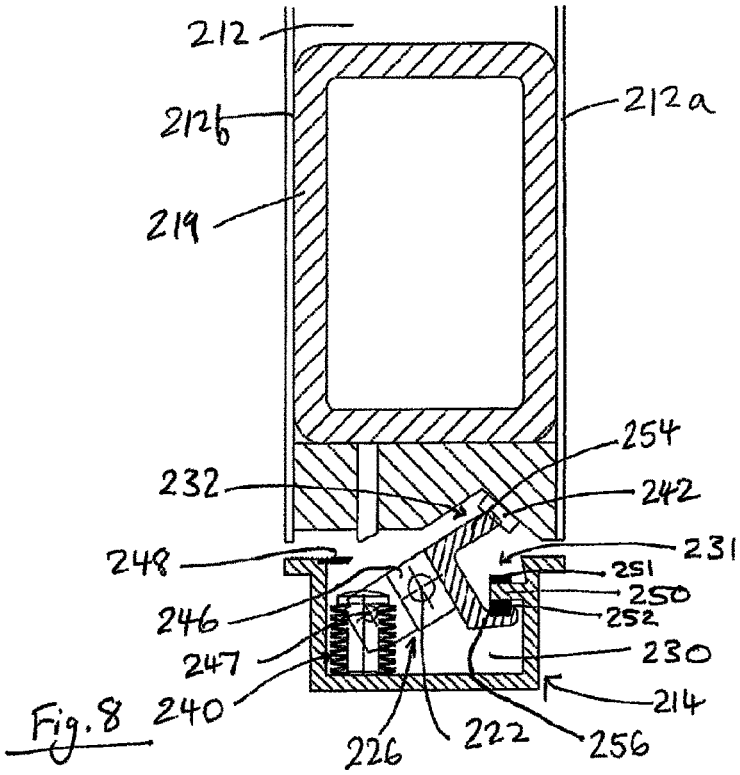
FIGS. 8 and 9 show cross-sectional views of a further alternative embodiment with the locking device in locked and unlocked conditions respectively.
Figure 9:
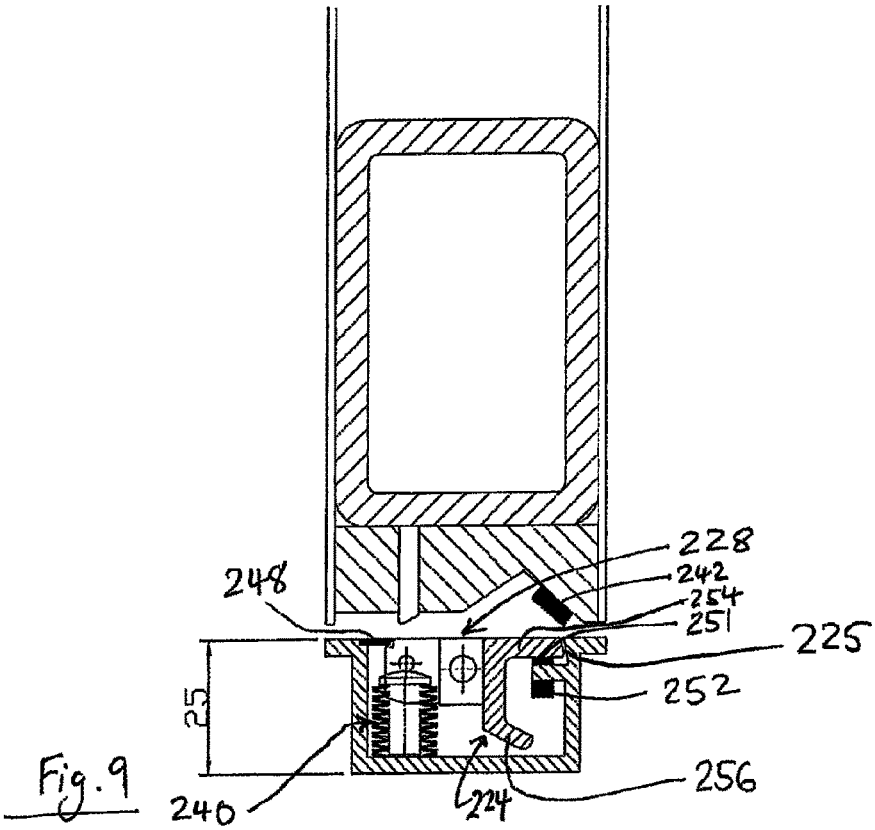

FIGS. 8 and 9 show a further alternative embodiment of the locking device in which the cam has a non-arcuate cam surface. In the present embodiment the cam 220 is housed in a carrier recess 230 in the face 231 of frame member 214 that faces leaf 212. However, the skilled reader will readily understand that, as with other embodiments, the cam 220 may be housed in a carrier recess in the leaf instead.

Adjacent and communicating with the carrier recess is a receiver recess 232, recessed in the edge of the leaf 212 which faces the cam 220. The receiver recess 232 is an elongate channel which is at least as long as the cam 220. The cam is rotatable about pivot pin 222. The cam 220 has a head portion 224 and a lever portion 226. Lever portion 226 is coupled to a similar actuator means 240 as described with reference to the FIG. 6 embodiment via pivot axis 247.

Unlike the cams of the previous embodiments, the cam 220 does not have an arcuate cam surface. Instead, cam 220 has a cam surface 225 at least a portion of which has a substantially planar surface. In this particular embodiment the cam surface 225 is an elongate planar end face of an arm of the cam, as will be described further below. The cam surface 225 is configured to engage a cam engaging surface 242 in receiver recess 232. The cam engaging surface 242 is a substantially planar surface (although it need not be). In this embodiment, the cam engaging surface 242 is disposed at an oblique angle relative to the plane of the leaf's closed position, the cam engaging surface 242 facing towards the leading face 212*b* of the leaf and the frame 218. In this embodiment, the cam engaging surface 242 of the receiver channel 232 is a cam sealing member engageable with the cam surface 225 when the cam is in the locked condition. The sealing member is made of any suitable resilient material. Alternatively the cam sealing member may be disposed on cam 220.

The carrier recess 230 includes a projection 250 extending into the recess such that at least part of the projection engages part of the head portion 224 of the cam when the cam 220 is in the unlocked condition. The projection 250 has a first sealing member 251 disposed thereon, configured to engage part of the head portion 224 of cam when it is in the unlocked condition, thus sealing recess 230 from ingress of moisture/debris etc when the cam is in the unlocked condition. The head portion 224 of the cam is furcated, having a first furcation 254 and a second furcation 256, the first furcation 254 having the cam surface 225 thereon. The furcations form a u-shape, or similar, in cross-section, with space therebetween for receiving the projection 250. The projection 250 has a second sealing member 252 disposed thereon, configured to engage the second furcation 256 of the cam when the cam is in the locked condition. This seals recess 230 from ingress of moisture/debris when the cam is in the locked condition. Sealing members 251, 252 can be made of any suitable resilient material. The projection 250 may also act as a stop to prevent the head portion of the cam from rotating further into the carrier recess 230 than its normal unlocked condition position.

The Cam 220 has a planar surface 228 facing towards the leaf 212, the planar surface 228 being flush with the face of the frame member that faces leaf 212 when the cam 220 is in the unlocked condition. The assembly has a sealing strip 248 disposed over the gap between the lever portion 226 of the cam and the receiver recess 230, to keep debris from falling into the receiver recess 230.

The leaf assembly may of course have other locking devices that can optionally be used instead of or as well as the presently described locking device, as and when desired by the user.

Those skilled in the art should appreciate that they may readily use the disclosure as a basis for designing or modifying other processes and structures for carrying out the same purposes and/or achieving the same advantages of the embodiments introduced herein. Those skilled in the art should also realize that such equivalent constructions do not depart from the spirit and scope of the disclosure, and that they may make various changes, substitutions and alterations herein without departing from the spirit and scope of the disclosure. The scope of the invention should be determined only by the language of the claims that follow. The term "comprising" within the claims is intended to mean "including at least" such that the recited listing of elements in a claim are an open group. The terms "a," "an" and other singular terms are intended to include the plural forms thereof unless specifically excluded.

The invention claimed is:

1. A leaf assembly comprising a door leaf and a frame, the leaf being pivotally mounted in the frame, the leaf having a leading face, a trailing face, a bottom edge and side edges, the frame being mounted in an external wall of a building and being pivotally moveable relative to the frame between an open position and a closed position, the leaf being mounted with its trailing face facing externally of the building and the leading face facing internally, the leaf assembly further comprising a locking device comprising a cam rotatable between an unlocked condition and a locked condition, the cam being rotatable in a first direction towards the locked condition and in a second, opposite direction, away from the locked condition, the plane of rotation of the cam being perpendicular to the plane of the leaf when in the closed position, wherein in the locked condition the cam is engageable with a cam engaging surface on the leaf, engagement of the cam with the cam engaging surface preventing the leaf from moving away from the closed position, wherein the cam comprises a head portion and a lever portion arranged one on each side of a pivot axis, the head portion including a cam surface having an arcuate profile, the arcuate cam surface being arranged such that it is engageable with the cam engaging surface when the cam is in the locked condition, the assembly further comprising actuating means for rotating said cam from the unlocked to the locked condition, the actuating means exerting a force in use on the lever portion in order to move the cam from the unlocked to the locked condition, wherein the frame has at least a first face, the cam being mounted within a corresponding carrier recess in the first face of the frame, the assembly being adapted such that when the cam is in the unlocked condition, the cam is housed fully within the carrier recess, wherein the assembly further includes a first cam sealing member incorporated on the cam surface or the cam engaging surface such that a seal forms between the cam and the leaf when the cam is in the locked condition, and wherein the cam is arranged to rotate such that when the cam is in the locked condition, exertion of a leaf opening force on the trailing face of the leaf urges the cam to rotate in the first direction, whereby the seal formed between the cam and the leaf is enhanced, wherein the lever portion of the cam has a planar surface, the planar surface of the lever portion being arranged such that when the cam is in the unlocked condition and the cam is fully housed within the carrier recess, the planar surface of the lever portion is flush with the first face of the frame; the planar surface of the lever portion and the arcuate cam surface of the head portion together forming a continuous surface that extends across the pivot axis.

2. The leaf assembly according to claim 1, wherein the device is adapted such that when the cam is in the locked condition, the exertion of a leaf opening force on the trailing face of the leaf forms a seal, or enhances a seal between the leaf and the frame.

3. The leaf assembly according to claim 1, wherein the cam is mountable at a corresponding edge of the leaf, the cam being rotatable about an axis of rotation which is parallel with said edge of the leaf.

4. The leaf assembly according to claim 1, wherein the cam is biased towards the unlocked condition.

5. The leaf assembly according to claim 1, wherein the device further comprises biasing means for biasing the cam towards the unlocked condition.

6. The leaf assembly according to claim 5, wherein the biasing means is a spring.

7. The leaf assembly according to claim 1, wherein the cam is rotatable about an axis of rotation located between the cam surface and the lever portion, such that the cam surface rotates in an opposite direction from the lever portion as the cam moves between the locked and unlocked conditions.

8. The leaf assembly according to claim 1, wherein the actuating means exerts a pushing force on the lever portion in order to move the cam from unlocked to the locked condition.

9. The leaf assembly according to claim 1, wherein the actuating means comprises a linear actuator.

10. The leaf assembly according to claim 9, wherein the linear actuator is moveable linearly between a retracted position and an extended position in which it exerts a pushing force on the lever portion of the cam.

11. The leaf assembly according to claim 1, wherein the actuating means comprises a pneumatic, hydraulic, mechanical, electro-magnetic or electro-mechanical actuator.

12. The leaf assembly according to claim 1, wherein said first cam sealing member is disposed on the cam.

13. The leaf assembly according to claim 1, wherein the cam is elongate.

14. The leaf assembly according to claim 13, wherein the of elongate cam has a longitudinal axis and the cam is mounted at a corresponding edge of the leaf, a length of the cam along the respective longitudinal axis substantially matching a length of an edge of the leaf that the cam is mounted at.

* * * * *